US010881563B2

(12) United States Patent
Bosik

(10) Patent No.: US 10,881,563 B2
(45) Date of Patent: Jan. 5, 2021

(54) DEVICE TO ASSIST PERSON RISING FROM A SEATED POSITION

(71) Applicant: Anthony Bosik, Greely (CA)

(72) Inventor: Anthony Bosik, Greely (CA)

( * ) Notice: Subject to any disclaimer, the term of this patent is extended or adjusted under 35 U.S.C. 154(b) by 0 days.

(21) Appl. No.: 16/519,343

(22) Filed: Jul. 23, 2019

(65) Prior Publication Data

US 2020/0323714 A1 Oct. 15, 2020

(51) Int. Cl.
*A61G 5/14* (2006.01)

(52) U.S. Cl.
CPC ..... *A61G 5/14* (2013.01)

(58) Field of Classification Search
CPC ..... A61G 5/14
See application file for complete search history.

(56) References Cited

U.S. PATENT DOCUMENTS 3,739,793 A 6/1973 Wilson
4,314,576 A * 2/1982 McGee ..... A61F 5/0104 135/67
4,474,202 A * 10/1984 Blechner ..... A61H 3/00 135/67
4,843,661 A 7/1989 Skibinski
5,347,666 A * 9/1994 Kippes ..... A61G 7/10 135/67
5,449,013 A 9/1995 Landers
5,509,152 A * 4/1996 Kippes ..... A61G 7/10 135/67
5,509,432 A * 4/1996 Peterson ..... A61G 7/1038 135/65
5,983,911 A * 11/1999 Steele ..... A61G 5/1094 135/66

FOREIGN PATENT DOCUMENTS

CA 2133282 4/1995

* cited by examiner

*Primary Examiner* — Noah Chandler Hawk
(74) *Attorney, Agent, or Firm* — Ronald G. Bitner

(57) ABSTRACT

A device to assist a person to rise from a seated position comprising a pair of vertical laterally spaced frame members, in which each frame members has an elongated sloped handrail extending along the top of the frame members, whereby the hand rails provide hand gripping regions to assist a user from an initial seated position to rise by pulling on a lower region of the handrail, while reacting with foot on a floor member, and further provides progressively higher gripping regions for support while standing and walking.

1 Claim, 1 Drawing Sheet

DEVICE TO ASSIST PERSON RISING FROM A SEATED POSITION

FIELD OF THE INVENTION

The present invention relates to a device for assisting persons who have difficulty rising from a seated position.

BACKGROUND OF THE INVENTION

Many people have difficulty rising from a seated position, because of a medical or physical condition, advanced age, or reduced mobility. Rising is made more difficult when a person is deeply seated on a chair, sofa, or toilet seat.

There are a number of devices which have been utilized or proposed to assist disabled persons to sit and to rise. However, these devices are not entirely satisfactory for assisting persons through the process of rising from a seated position and thereafter providing support for subsequent standing and walking.

U.S. Pat. No. 5,449,013 or Canadian Patent No. 2,133,282, discloses a device having hand grips for assisting a disabled person to rise from a seat to a standing position. However this device has no provision or support to provide stability for a person after rising for subsequent stepping and walking.

SUMMARY OF THE INVENTION

An object of the present invention is to provide a device for assisting persons who have difficulty rising from a seated position.

Another object is to provide a relatively simple device to assist a person in rising from a seated position and to provide support and stability when upright while stepping and walking out from the device.

It has been found that an improved device for assisting persons to rise from a seated position can be provided by a device that employs elongated sloped handrails mounted on a pair of spaced frames, whereby said slopped hand rail provides hand gripping regions to assist a user, from an initial seated position, to rise by pulling themselves forward and up while grasping a lower region of the handrail, while reacting with feet on a transverse floor member that interconnects the frame members, and further provides progressively higher support regions for standing and walking.

The present invention provides a device to assist a person to rise from a seat comprising: a pair of vertical laterally spaced frame members; each of said frame members comprising; an elongated base portion; a rear upright portion extending upward from the rear of said base portion; a longer front upright portion extending upward from the front of said base portion; and a sloped handrail extending from the top of the rear upright portion to the top of the longer front upright portion; a transverse floor member attached to the base portion of each frame member for interconnecting the frame members; whereby said slopped handrail provides hand gripping regions to assist a user from an initial seated position to rise by pulling themselves forward and upward on a lower region of the handrail, while reacting with foot on the transverse floor member, and provides higher gripping regions for support while standing and walking.

DESCRIPTION OF THE PREFERRED EMBODIMENTS

Figure 1:
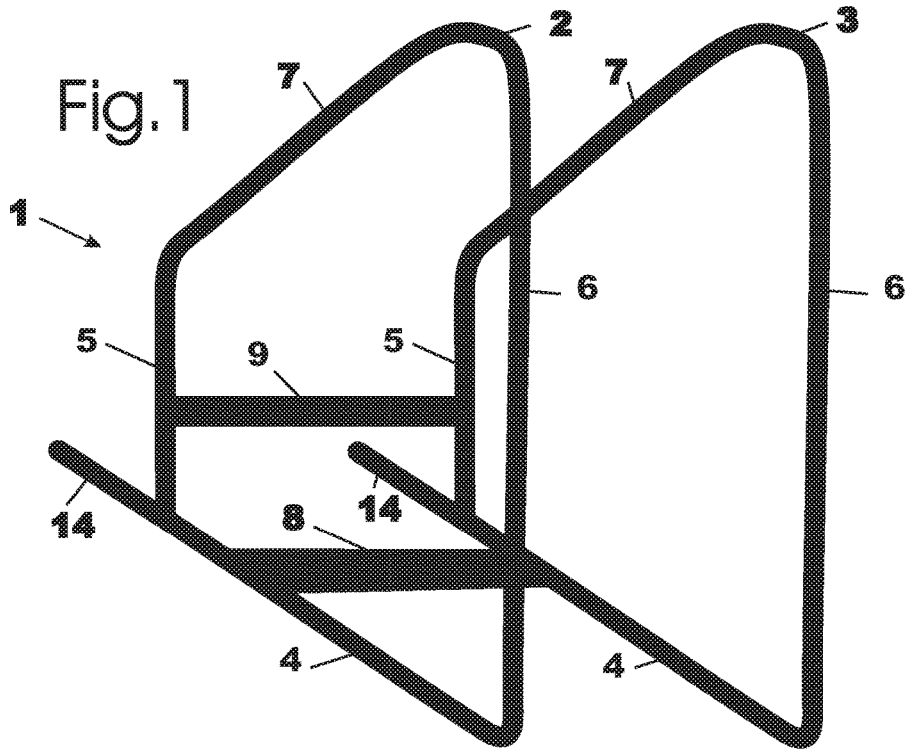
FIG. 1 is a perspective view of an embodiment of the present invention.

With reference to the drawings, the present invention is a device 1 comprising a pair of vertical laterally spaced frame members 2 and 3, each having an elongated base portion 4, a rear upright portion 5 and a longer front upright portion 6. An elongated sloped handrail defining portion 7 extends from, and interconnects the top of the rear upright portion 5 to the top of the higher front upright portion 6.

The frame members 2 and 3 are interconnected by a transverse floor member 8 attached to the base portion 4 of each frame member. A horizontal member 9, connected between the rear upright portions 5 of the frame members, provides integrity and strength for the device. For a typical use member 9 will be positioned in proximity to, or contact the seat the user is rising from.

As shown, the frame members 2 and 3, each comprising interconnected portions 4, 5, 6 and handrail 7 form a closed loop providing a simple integrated frame unit.

Extending rearward from each of the base portions 4, are stabilising members 14, for minimizing the tendency for rearward tilting of the device, in use. Typically, in use, the members 14 will extend under the seat.

Figure 2:
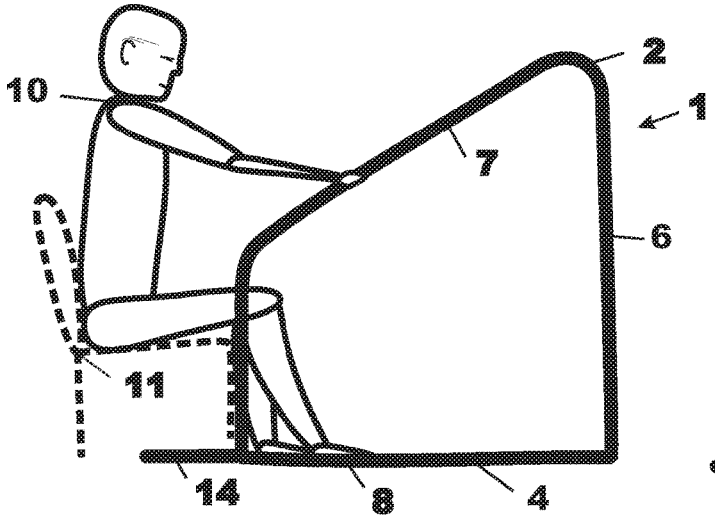
FIG. 2 is a side view showing the present invention in use by a person preparing to rise from a seated position.
Figure 3:
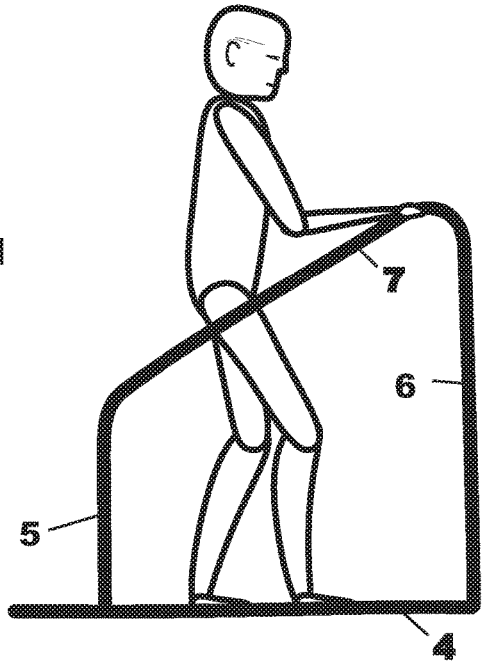
FIG. 3 shows the present invention in use by a person after having risen from the seated position.

FIGS. 2 and 3 illustrate the use of the device for a person 10 rising from a seat 11, With reference to FIG. 2, for use with a sofa, or other seat 11, the device 1 is positioned with the rear upright portions 5 and/or transverse member 9 against the front of the seat 11, and members 14 extending under the seat.

FIG. 2 shows a person 10 preparing to rise from a seated position by grasping a lower region of the handrail 7. To rise the person's foot is planted on, and reacts against the transverse floor member 8, while pulling themselves forward and upward to an upright standing position. This method has been found to make rising easier for persons with reduced mobility.

FIG. 3 shows a person after having risen from the seated position in an upright position. The elongated sloped handrail provides additional higher grasping regions providing continuing and extended support while the person steps and walks through and out from the device. The extended support facilitates the transition from a sedentary position to a stable upright and walking position. Furthermore, the sloped handrail provides a range of gripping region heights making it convenient for persons of various sizes.

The frames 2 and 3, and other members, can be constructed of various materials and methods, including plastics, aluminum or steel.

An example of dimensions for the device found to be suitable for a range of person sizes include: Height of the sloped handrail at the lower end, 20 inches, and 33 inches at the higher end. Width, or spacing of the frames: 24 inches. Horizontal length of the frames, between uprights: 20 inches. Floor member distance from the lower rear end of device, for foot placement: 11 inches to the centre of a 4 inch wide plate. Centre of bottom transverse member: 11 inches from rear lower end. Suitable frame construction consisted of 1 inch diameter aluminum tubing 1 with 0.062 wall thickness.

The sloped handrail provides a range of gripping region heights to accommodate persons of various sizes. It will be understood that the device can be made with different dimensions for special needs. The handrail may be provided with a resilient grip material.

It will be understood that the device may be provided with disassembled components for compact shipping or storage. For example, the two frame members, may be designed to be bolted, or otherwise interconnected with the transverse connecting members, for use.

It will be appreciated that the present device can be used to assist a person from various forms of seating, including chairs, sofas, beds, toilet seat, and that the device can also be used to assist a person to lower from a standing position to a sitting position. Also, the extended handrails provide support and stability to transfer to a wheel chair, or walker, or just simply walk.

The invention claimed is:

1. A device to assist a person to rise from a seated position comprising:

a pair of vertical laterally spaced frame members;

each of said frame members comprising;

an elongated base portion;

a rear upright portion extending upward from the rear of said base portion;

a longer front upright portion extending upward from the front of said base portion;

and a sloped elongated handrail extending from the top of the rear upright portion to the top of the longer front upright portion;

a transverse floor member attached to the base portion of each frame member for interconnecting the frame members;

a stabilising member extending rearward from the base portion of each frame member for minimising tilting;

a horizontal connecting member interconnecting said rear uprights portions of the frames; and an open region with respect to adjacent structure including said laterally spaced frame members, handrails and front upright portions for allowing egress from the device;

whereby said sloped elongated handrail provides hand gripping regions to assist a user from an initial seated position to rise by pulling themselves forward and upward on a lower region of the handrail, while reacting with feet on the transverse floor member, and provides higher gripping regions for support while standing and walking, and whereby the base portion, the front and rear upright portions, and the handrail of each frame form a loop, whereby said handrail defines the top of the frame, and whereby said open region allows a person to walk through and out from the device between the front upright portions.

* * * * *